US006875138B2

(12) United States Patent
Perkins, Sr.

(10) Patent No.: US 6,875,138 B2
(45) Date of Patent: Apr. 5, 2005

(54) ARCHERY BROADHEAD WITH REPLACEABLE BLADES

(75) Inventor: Derrick Perkins, Sr., Stuart, FL (US)

(73) Assignee: Liberty Research Co., Gonic, NH (US)

( * ) Notice: Subject to any disclaimer, the term of this patent is extended or adjusted under 35 U.S.C. 154(b) by 0 days.

(21) Appl. No.: 10/691,998

(22) Filed: Oct. 24, 2003

(65) Prior Publication Data

US 2004/0092342 A1 May 13, 2004

Related U.S. Application Data

(60) Provisional application No. 60/420,682, filed on Oct. 24, 2002.

(51) Int. Cl.[7] ..... F42B 6/08

(52) U.S. Cl. ..... 473/583; 473/584

(58) Field of Search ..... 473/583, 584

(56) References Cited

U.S. PATENT DOCUMENTS

| | | | | | |
|---|---|---|---|---|---|
| 2,993,697 | A | * | 7/1961 | Urban | |
| 4,781,386 | A | * | 11/1988 | Armitage | 473/584 |
| 4,807,889 | A | * | 2/1989 | Johnson | 473/584 |
| 5,636,845 | A | * | 6/1997 | Newnam | |
| 5,636,846 | A | * | 6/1997 | Tinsley | 473/584 |
| 6,045,468 | A | * | 4/2000 | Tinsley et al. | 473/584 |
| 6,077,180 | A | * | 6/2000 | Adams, Jr. | 473/584 |

* cited by examiner

*Primary Examiner*—John A. Ricci
(74) *Attorney, Agent, or Firm*—Sterne, Kessler, Goldstein & Fox P.L.L.C.

(57) ABSTRACT

A broadhead includes a ferrule for mounting an arrowshaft, the ferrule having a locking portion. At least two blades are mounted on the ferrule (three are used in the preferred embodiment), the blades being coupled to the ferrule in their center portions by notches that mate with the locking portion of the ferrule. A locking nut is mounted on a rear portion of the ferrule for holding the three blades in place on the ferrule when the locking nut is tightened.

23 Claims, 9 Drawing Sheets

ARCHERY BROADHEAD WITH REPLACEABLE BLADES

CROSS-REFERENCE TO RELATED APPLICATIONS

This application claims priority to U.S. Provisional Patent Application No. 60/420,682, Filed: Oct. 24, 2002, Titled: IMPROVED ARCHERY BROADHEAD WITH REPLACEABLE BLADES, which is incorporated by reference herein.

BACKGROUND OF THE INVENTION

1. Field of the Invention

The present invention generally relates to arrowheads for arrows, particularly to broadhead arrowheads, and specifically to broadhead arrowheads formed from replaceable and interchangeable components.

2. Related Art

The sport of archery includes activities ranging from target practice to game hunting, and the art of providing arrows suitable for each of such purposes has become highly developed. Archery is a type of leisure activity having a very active following. There is a continual demand in the archery field for improved equipment including arrowheads for arrow shanks. Specifically, a need exists for arrowheads that are strong and durable even though of an assembled nature. Further, such arrowheads should allow ease of assembly to allow the use of replaceable and interchangeable components including blades allowing the cutting edges of the arrowhead to be sharpened or replaced. Furthermore, even though easily disassembled by the user, such arrowheads should not fall apart in use even when hitting firm or solid objects such as bones. Additionally, such arrowheads should have a minimal weight ratio to allow use of heavier blades while minimizing the total weight. Likewise, such arrowheads should maximize the cutting edges of the blades and provide minimum resistance for maximum penetration.

A great many types of arrowheads have been developed, with each designed to serve a particular purpose and having specific operating characteristics. Thus, arrowheads specifically intended for hunting large, thick-skinned, heavy-boned game such as bear have been developed. Additionally, heads particularly suitable for hunting large thinner-skinned, lighter-boned game such as deer have been developed. Arrowheads have also been developed for hunting fowl, particularly turkey, for hunting squirrels and other small game, and for bow-fishing. When such specially designed arrowheads are attached to the arrow shaft in non-releasable fashion, it is necessary for the archer to have a wide range of arrows, some for target shooting, some for hunting larger game, some for smaller game.

Arrowheads with interchangeable blades have been proposed in an effort to increase the versatility of the arrowhead while economizing in the amount of materials needed for production. Systems typical of this general approach are disclosed in U.S. Pat. No. 2,940,758 to Richter, U.S. Pat. No. 4,036,479 to Sherwin, U.S. Pat. No. 4,146,226 to Sorenson and U.S. Pat. No. 4,210,330 to Kosbab. Such systems typically employ a plurality of independent blades, each of which can be fitted into a different one of a plurality of slots in a central body. Usually, the blades are then clamped by axially-acting clamp members that are separate from the arrowhead body, or the body itself may act as a clamp member. Since a plurality of blades are clamped, the blades tend to be held less securely and tend to become loose during use. Since the blades themselves must be clamped to the arrowhead body, there is an increased likelihood that the blades will fracture or shear on impact, at or near the points where the blade is clamped. Moreover, leading edge clamps are blunt, as compared to the edges of the blades, which impedes penetration.

While prior-art proposals have achieved significant acceptance in the trade, there has been a continuing need for improvement, particularly in the ease of assembly of the arrowhead and its ability, once assembled, to withstand the rigors of actual use.

SUMMARY OF THE INVENTION

Accordingly, the present invention is related to an improved broadhead with replaceable components that substantially obviates one or more of the disadvantages of the related art.

In one embodiment, there is provided a broadhead including a ferrule for mounting an arrowshaft, the ferrule having a locking portion. At least two blades are mounted on the ferrule (three are used in a preferred embodiment), the blades being coupled to the ferrule in their center portions by notches that mate with the locking portion of the ferrule. A locking nut is mounted on a rear portion of the ferrule for holding the three blades in place on the ferrule when the locking nut is tightened.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS/ FIGURES

DETAILED DESCRIPTION OF THE INVENTION

Reference will now be made in detail to the preferred embodiments of the present invention, examples of which are illustrated in the accompanying drawings.

Figure 2:
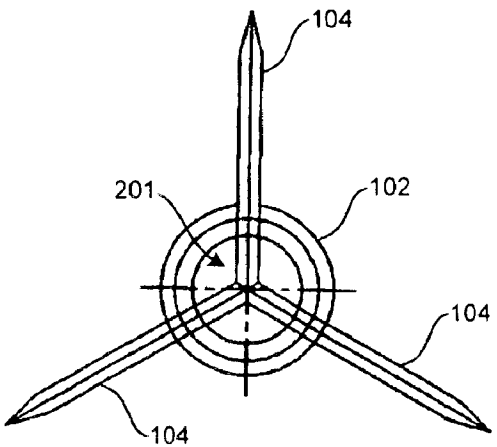
FIG. 2 shows a head-on view of the broadhead of FIG. 1A.
Figure 1A:
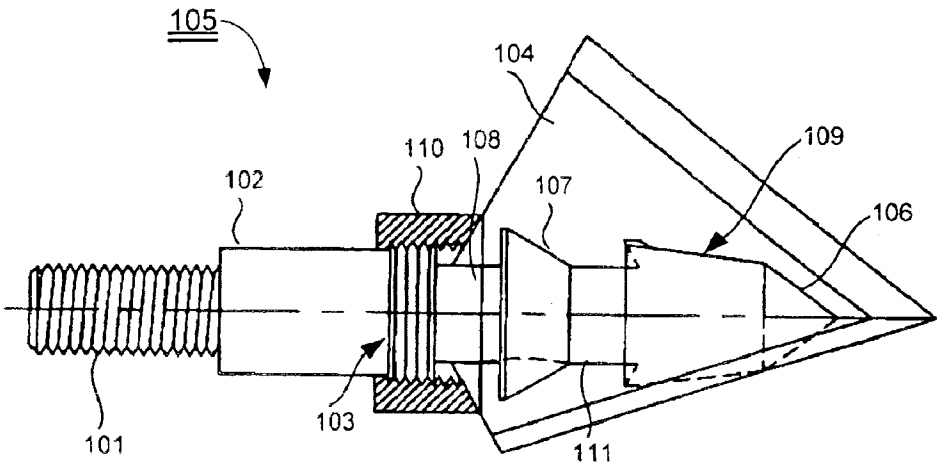
FIGS. 1A and 1B show a side view of an assembled broadhead of two embodiments of the present invention.

FIG. 1A shows a side view of an assembled broadhead of one embodiment of the present invention, and FIG. 2 shows a head on view of the same broadhead. As shown in FIGS.

1A and 2 (generally moving from left to right in FIG. 1A), the broadhead has a mating portion 101 that attaches to an arrowshaft (not shown). A ferrule 105 has a rear body portion 102 with a locking thread 103, on which a locking nut 110 is mounted. The ferrule 105 also has a center cylindrical body portion 108, a flange 107, and a forward cylindrical body portion 11. A conical front portion 109 includes a conical ferrule tip portion 106.

Figure 1B:
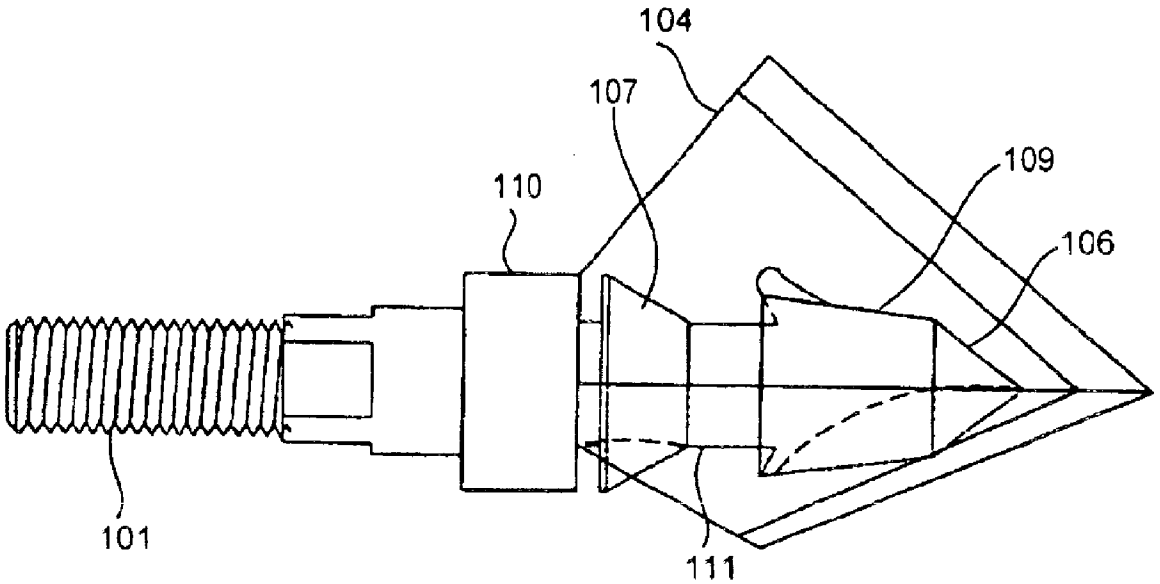

The ferrule 105 also forms the mounting element for blades 104. In the preferred embodiment, three blades 104 are mounted on the ferrule 105, such that upon mounting of the blades 104, the locking nut 110 is used to tighten the blades 104 in place on the ferrule 105 FIG. 1B shows another embodiment of the broadhead, with a blade as illustrated in FIG. 5C, discussed below.

Figure 4:
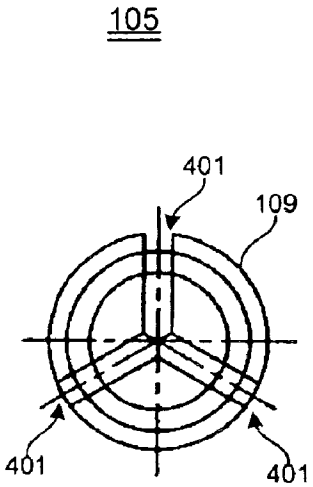
FIG. 4 shows a head-on view of the ferrule of FIG. 3A.
Figure 3A:
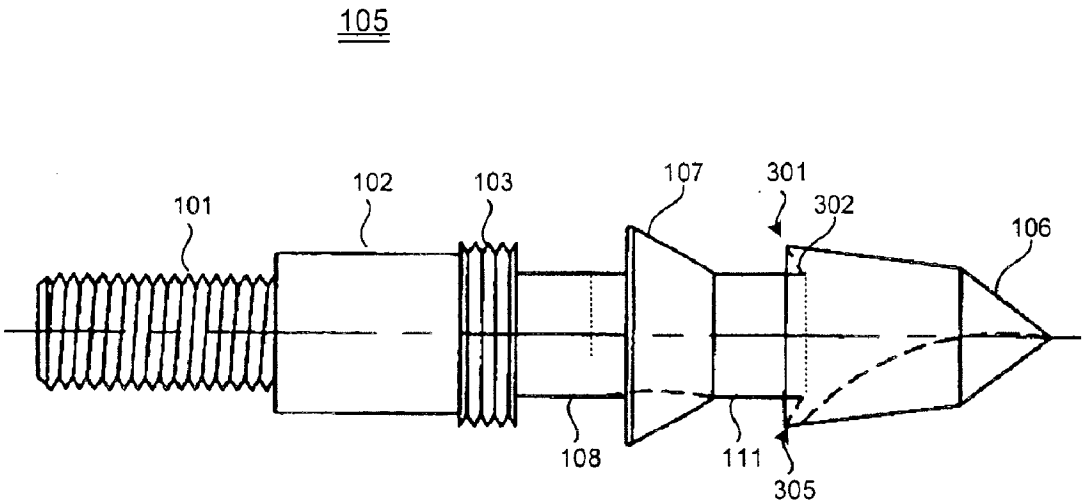
FIGS. 3A and 3B show a detailed view of the ferrule used in the broadhead of FIGS. 1A and 1B, respectively.
Figure 3B:
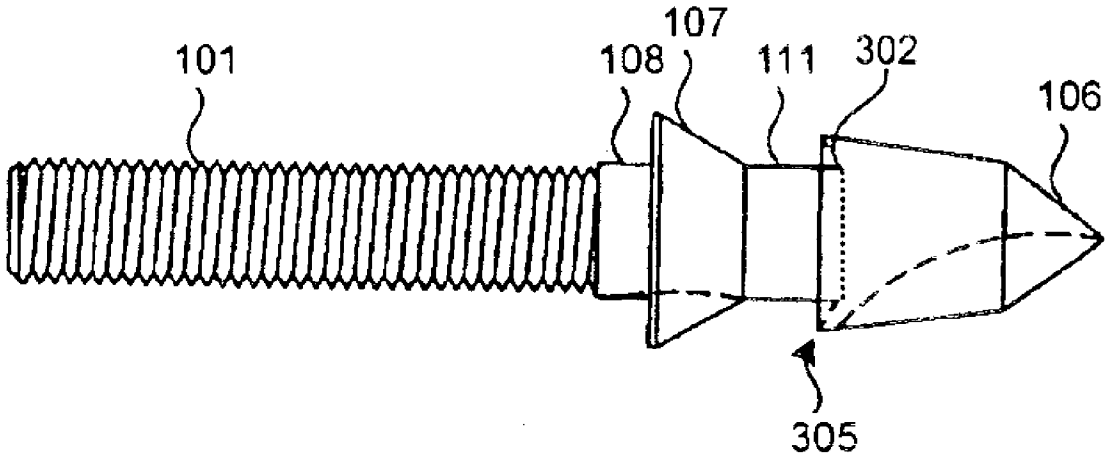

FIG. 3A is a detailed illustration of the ferrule 105 of the present invention. With regard to FIG. 3A, note in particular a recess portion 301, formed by surfaces 302 and an outer surface of the cylindrical body portion 111. The recess portion 301 is used to assist with locking the blades 104 into place by using a locking projection 305. The curved dashed line in FIG. 3A corresponds to a slot 401, shown in FIG. 4, which illustrates a head on view of the ferrule 105. Note in particular the slots 401, each of which receives one blade 104 for mounting on the ferrule 105. FIG. 3B illustrates an alternative embodiment of the ferrule 105, with a smaller center cylindrical body portion 108. This embodiment can be used with the locking nut 110 shown in FIG. 1B and FIGS. 7A–7B (discussed below).

Figure 5A:
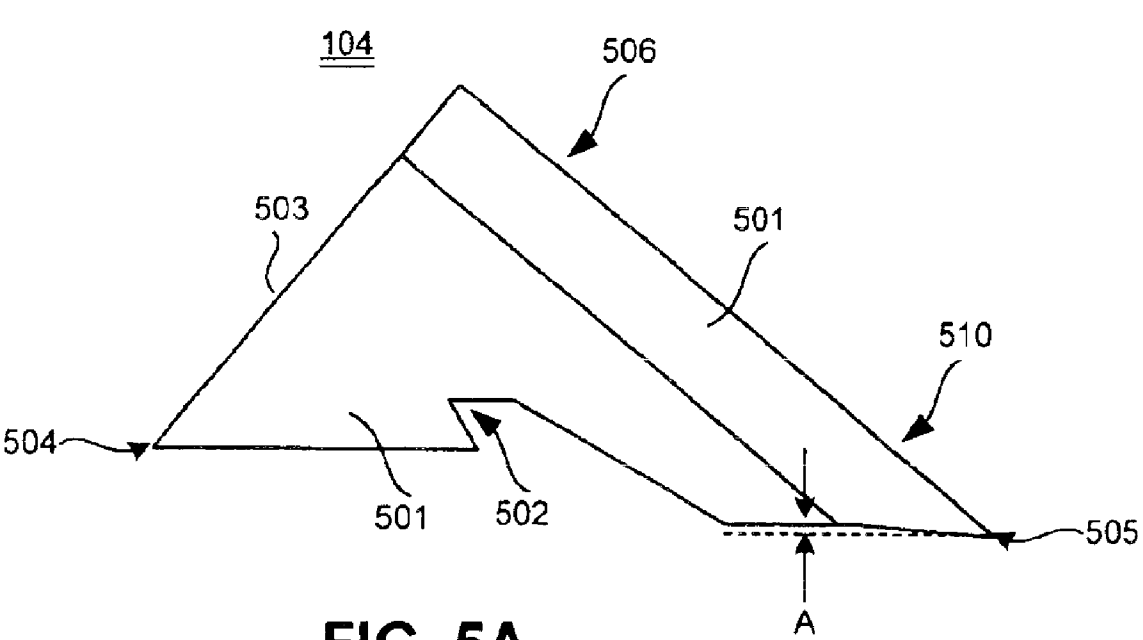
FIGS. 5A–5C show detailed views of broadhead blades of FIGS. 1A and 1B.
Figure 5B:
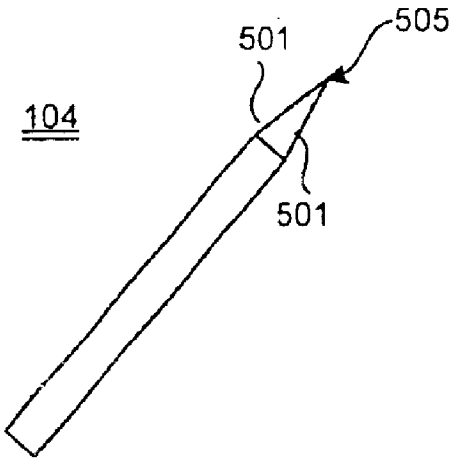
Figure 5C:
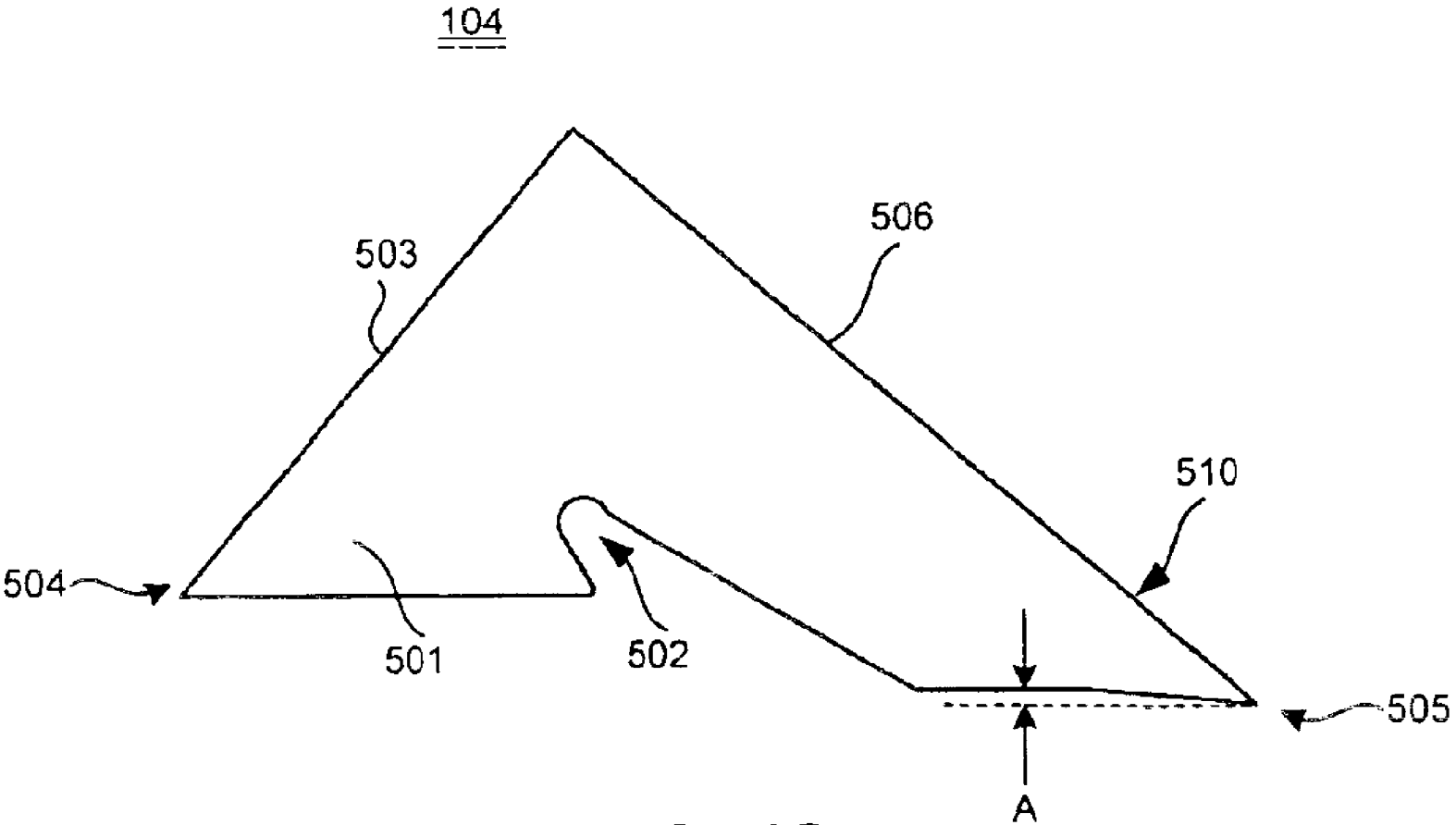

FIGS. 5A–5B are detailed illustrations of the blade 104, showing a side view and an end view, respectively. Note that in this and other figures, the dimensions and angles shown are exemplary only, and should not be viewed as constituting a limitation of the invention. As shown in FIGS. 5A–5B, the blade 104 includes a forward edge surface 501, which is ground to form a razor edge. Furthermore, the blade 104 includes a notch (or recess) portion 502, such that the locking projection 305 and the notch portion 502 mate with surfaces 302, 111, and the recess portion 301 of the ferrule 105. The blade 104 also includes a rear edge 503 (usually not sharpened), a rear locking surface 504 (for coupling to the locking nut 110), a blade edge 506, a forward portion 510 and a forward tip point 505. There may be a clearance at "A," as shown in FIG. 5A, or, alternatively, the forward portion may be beveled at 120° (see location 201 in FIG. 2). FIG. 5C shows another embodiment of the blade 104, with the area "B" of the blade 104 (part of the notch portion 502) having a gradual curvature.

Figure 6:
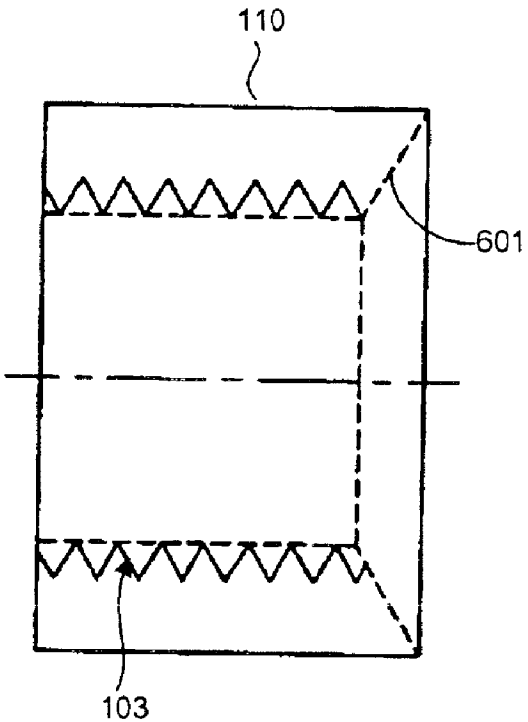
FIG. 6 is a detailed view of the locking nut of the broadhead of FIG. 1.

FIG. 6 illustrates the locking nut 110, which preferably has a light straight knurl on its outer surface (not shown in the figures). The locking nut 110 is used to tighten blades 104 on the ferrule 105 once the blades 104 are mounted on the ferrule 105. The locking nut 110 also has an angled portion 601, which abuts the blades 104 when tightened. The angled portion 601 supports the blades 104 when tightened.

Further with reference to FIGS. 2 and 5A, in one embodiment, the forward portions 510 of the blades 104 may abut each other, as shown in the center of FIG. 2 (see location 201 in FIG. 2). Each of the blades 104 is machined (beveled) in their forward portions at 120° (or 360° divided by the number of blades in a particular embodiment, if the number of blades is other than three), such that when the three blades 104 are brought together, they abut each other snugly.

The broadhead of the present invention has an advantage in that it has user-replaceable blades that "cut on impact." The "cut on impact" feature permits the cutting edge of the blades 104 to begin cutting upon impact, compared to a conventional solid tip that secures the tips of the three blades 104. Furthermore, the broadhead of the present invention can "lock in" the blades 104 to the ferrule 105 in the middle portion of the ferrule 105 and the blades 104, further enhancing stability and performance of the broadhead. Thus, unlike conventional broadheads that use notches at ends of a ferrule, the present invention uses the recess portion 301 in the center portion of the ferrule 105, resulting in a more stable broadhead upon impact.

As noted above, the broadhead of the present invention, in one embodiment, has blades 104 that support each other during impact due to the 120° beveling arrangement. Furthermore, the broadhead has a locking nut 110 that retains the blade 104 in the ferrule body 105 at the location on the ferrule body 105 shown in FIG. 1A and 1B. This allows the broadhead to remain assembled even when it is not on the arrow shaft.

Securing the blades 104 at their leading edge tip may be disadvantageous, because the blade tip is thinner, and thus weaker. Securing the blades 104 at about their mid-section provides for a much more secure fastening technique, since the blades 104 are stronger at that point. In addition to having the spine (forward) portions of the blades 104 beveled at 120°, it is also possible to have the back of the tips be somewhat recessed (see clearance A in FIG. 5A), permitting clearance upon assembly. Thus, one of the advantages of the present invention is that it provides replaceability of individual blades 104 with cut-on-impact performance.

Figure 7B:
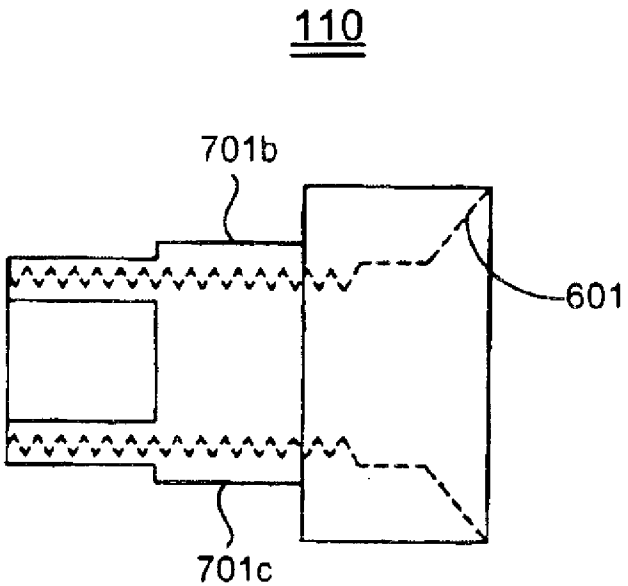
FIGS. 7A and 7B show an alternative embodiment of a locking nut.
Figure 7A:
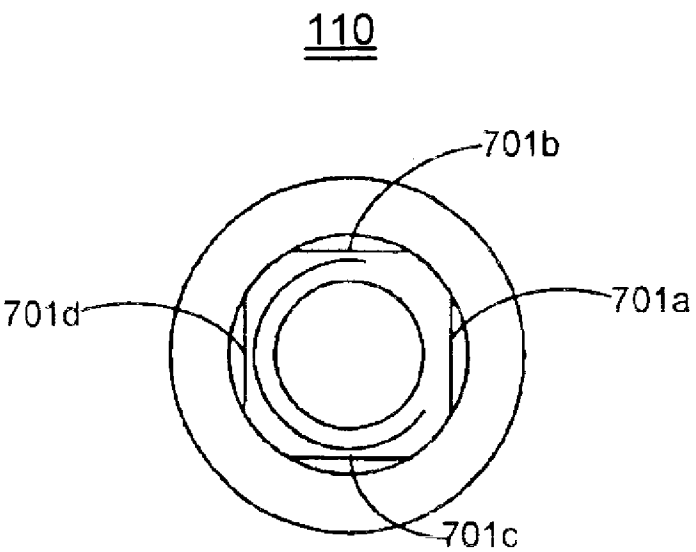
Figure 8:
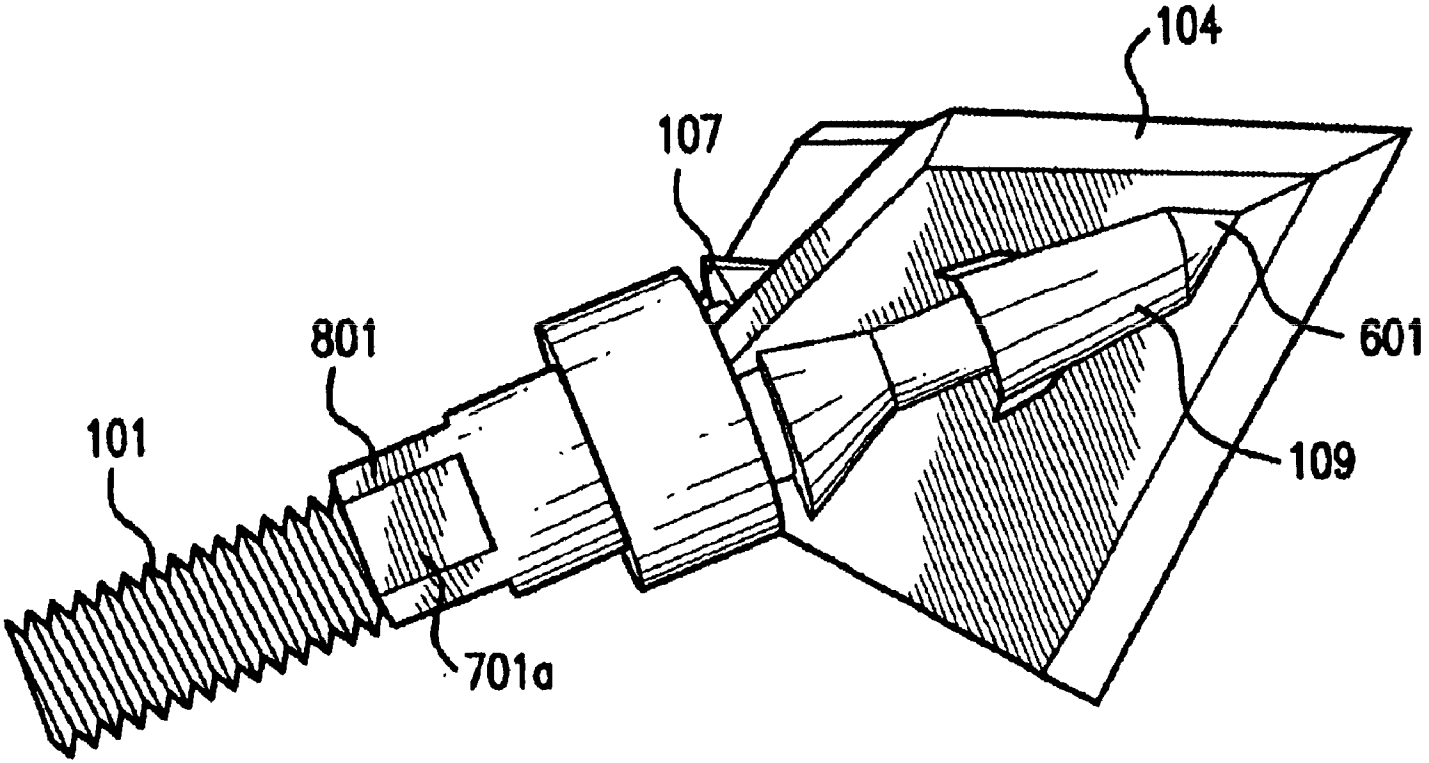
FIG. 8 shows a photograph the broadhead of FIG. 1B with the locking nut of FIGS. 7A and 7B.

Additionally, as shown in FIGS. 7A and 7B, showing a head-on view, and a side view, respectively, the locking nut 110 in its preferred embodiment, instead of having a round cross section with a knurl, can have flat surfaces (e.g., surfaces designated by 701*a*–701*d* in FIGS. 7A and 7B). These surfaces 701*a*–701*d* allow the broadhead to be assembled and tightened by hand prior to its being mated with the arrow shaft. The flat surfaces 701*a*–701*d* preferably have rounded corners (see 801 in FIG. 8, which shows a photograph of one embodiment of the invention), which serve to support the assembled broadhead in the arrow insert in a snug and vibration-free manner. This holds the broadhead more rigidly on the arrow, and does not permit it to move as much.

The blades 104 are usually made of stainless steel, preferably lead-free stainless steel. The nut and ferrule are also preferably made of steel, and preferably lead free steel. Titanium can also be used for any of the elements of the broadhead, including the nut 110, the ferrule 105, and the blades 104. Also, composite materials, or other metals may be used.

A typical manufacturing process for the blades 104 uses stamping and sharpening of the blades 104. The ferrule 105 is typically machined. Other manufacturing processes are possible, e.g., machining the blades 104.

Electroless nickel plating is preferred for the nut 110 and ferrule 105, although additional coatings may be added, such as various friction-reducing (or self-lubricating) coatings, deposited titanium nitride coatings, and Teflon™ coatings. Similarly, the blades 104, or the bolts (not shown in the figures) may be plated with any of the coatings described above as well.

One of the advantages of the present inventing is that an arrow with the broadhead described above has the same aerodynamic performance as an arrow with a field point, which is used for practicing. Thus, a shooter does not need to re-sight his bow when switching from practice arrowheads to the broadhead.

Arrows using the present invention have been measured moving in excess of 300 feet per second while holding field point accuracy and groupings. Conventional broadheads lose accuracy as speed increases (typically over 250 feet per second), and do not group like field points even at low speeds.

The three blades 104 described above mimic the fletching of the arrow (i.e., the "feather" part on the rear portion of the arrow). This improves the aerodynamic performance of the arrow.

Another advantage of the present invention is the high penetrating ability, compared to conventional broadheads. The broadhead of the present invention when used at 20 yards and 300 feet per second, results in an accuracy of ¼ inch.

Note that although the preferred embodiment has been described in terms of three blades 104, there may be fewer blades (e.g., two), or more blades (e.g., four or more), where the invention is also applicable.

While various embodiments of the present invention have been described above, it should be understood that they have been presented by way of example, and not limitation. It will be apparent to persons skilled in the relevant art that various changes in form and detail may be made therein without departing from the spirit and scope of the invention. This is especially true in light of technology and terms within the relevant art(s) that may be later developed. Thus, the present invention should not be limited by any of the above-described exemplary embodiments, but should be defined only in accordance with the following claims and their equivalents.

What is claimed is:

1. A broadhead comprising:

a ferrule for mounting on an arrowshaft, said ferrule having a locking portion;

at least two blades mounted on said ferrule, said at least two blades being coupled to said ferrule in their center portions by notches formed therein that mate with said locking portion of said ferrule; and a locking nut mounted on a rear portion of said ferrule that holds said at least two blades in place on said ferrule when said locking nut is tightened.

2. The broadhead of claim 1, wherein said at least two blades have opposing forward portions that are beveled for abutting each other upon assembly.

3. The broadhead of claim 1, wherein said ferrule has a plurality of slots, such that said at least two blades fit into a respective one of said slots.

4. The broadhead of claim 1, wherein said at least two blades have opposing forward portions that are separated by a clearance that allows tips of said at least two blades to touch each other upon assembly.

5. The broadhead of claim 1, wherein said ferrule has a flange forward of said locking nut.

6. The broadhead of claim 1, wherein said locking nut has a plurality of flat surfaces.

7. The broadhead of claim 1, wherein said blades have a self-lubricating coating.

8. The broadhead of claim 1, wherein said ferrule has a self-lubricating coating.

9. A broadhead comprising:

a ferrule having a locking portion;

at least two blades coupled to said ferrule with notches formed in the blade that mate with said locking portion; and a locking nut on a rear portion of said ferrule that holds said at least two blades in place on said ferrule, wherein said at least two blades have opposing forward portions that are beveled for abutting each other upon assembly.

10. The broadhead of claims 9, wherein said ferrule has a plurality slots, such that said at least two blades fit into a respective one of said slots.

11. A broadhead comprising:

a ferrule having a locking portion;

at least two blades coupled to said ferrule with notches formed in the blade that mate with said locking portion; and a locking nut on a rear portion of said ferrule that holds said at least two blades in place on said ferrule, wherein said at least two blades have opposing forward portions that are separated by a clearance that allows tips of said at least two blades to touch each other upon assembly.

12. A broadhead comprising:

a ferrule having a locking portion;

at least two blades coupled to said ferrule with notches formed in the blade that mate with said locking portion; and a locking nut on a rear portion of said ferrule that holds said at least two blades in place on said ferrule, wherein said ferrule has a flange forward of said locking nut.

13. A broadhead comprising:

a ferrule having a locking portion;

at least two blades coupled to said ferrule with notches formed in the blade that mate with said locking portion, each blade having a cutting tip; and a locking nut on a rear portion of said ferrule that holds said at least two blades in place on said ferrule, wherein said locking nut has a plurality of flat surfaces, and wherein said locking nut has an internal surface angled to force said at least two blades together at said cutting tips.

14. A broadhead comprising:

a ferrule having a locking portion;

at least two blades coupled to said ferrule with notches formed in the blade that mate with said locking portion, each blade having a cutting tip; and a locking nut on a rear portion of said ferrule that holds said at least two blades in place on said ferrule, wherein said blades have a self-lubricating coating, and wherein said locking nut has an internal surface angled to force said at least two blades together at said cutting tips.

15. A broadhead comprising:

a ferrule having a locking portion;

at least two blades coupled to said ferrule with notches formed in the blade that mate with said locking portion, each blade having a cutting tip; and a locking nut on a rear portion of said ferrule that holds said at least two blades in place on said ferrule, wherein said ferrule has a self-lubricating coating, and wherein said locking nut has an internal surface angled to force said at least two blades together at said cutting tips.

16. A broadhead comprising:

a ferrule having a locking portion;

at least two blades coupled to said ferrule with notches formed in the blade that mate with said locking portion, each blade having a cutting tip; and a locking nut on a rear portion of said ferrule that holds said at least two blades in place on said ferrule, wherein said locking nut has an internal surface angled to force said at least two blades together at said cutting tips.

17. The broadhead of claim 16, wherein said at least two blades have opposing forward portions that are beveled for abutting each other upon assembly.

18. The broadhead of claim 16, wherein said ferrule has a plurality of slots, such that said at least two blades fit into a respective one of said slots.

19. The broadhead of claim 16, wherein said at least two blades have opposing forward portions that are separated by a clearance that allows said cutting tips to touch each other upon assembly.

20. The broadhead of claim 16, wherein said ferrule has a flange forward of said locking nut.

21. The broadhead of claim 16, wherein said locking nut has a plurality of flat surfaces.

22. The broadhead of claim 16, wherein said blades have a self-lubricating coating.

23. The broadhead of claim 16, wherein said ferrule has a self-lubricating coating.

* * * * *